US009063479B2

(12) United States Patent
Jensen et al.

(10) Patent No.: US 9,063,479 B2
(45) Date of Patent: Jun. 23, 2015

(54) SYSTEMS AND METHODS FOR IMPLEMENTING A DOUBLE BELT ROLL FUSER GEOMETRY IN AN IMAGE FORMING DEVICE

(71) Applicant: XEROX Corporation, Norwalk, CT (US)

(72) Inventors: Christopher Alan Jensen, Rochester, NY (US); Steven Matthew Russel, Bloomfield, NY (US); David P. Vanbortel, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 86 days.

(21) Appl. No.: 13/770,913

(22) Filed: Feb. 19, 2013

(65) Prior Publication Data

US 2014/0233993 A1 Aug. 21, 2014

(51) Int. Cl.
*G03G 15/20* (2006.01)
*G03G 13/20* (2006.01)

(52) U.S. Cl.
CPC ..... *G03G 13/20* (2013.01); *G03G 15/2028* (2013.01); *G03G 15/2025* (2013.01); *G03G 2215/2009* (2013.01); *G03G 2215/2029* (2013.01); *G03G 2215/2093* (2013.01)

(58) Field of Classification Search
CPC ..... G30G 15/2028; G30G 21/2085
USPC ..... 399/322, 323
See application file for complete search history.

(56) References Cited

U.S. PATENT DOCUMENTS

| | | | | |
|---|---|---|---|---|
| 5,319,429 | A * | 6/1994 | Fukuchi et al. | 399/321 |
| 5,927,189 | A * | 7/1999 | Jones et al. | 101/23 |
| 6,721,532 | B2 * | 4/2004 | Kosugi et al. | 399/341 |
| 7,457,576 | B2 | 11/2008 | Takada et al. | |

* cited by examiner

*Primary Examiner* — Gregory H Curran
(74) *Attorney, Agent, or Firm* — Ronald E. Prass, Jr.; Prass LLP

(57) ABSTRACT

A system and method are provided to implement a double belt roll fuser geometry to enable consistent self-stripping of image receiving media exiting a fuser assembly in an image forming device. Interaction between an image receiving medium substrate and a fuser belt of a belt roll fuser device is modified to include configuration in which an opposing belt is positioned around a pressure roller to oppose the fuser belt provided around the fuser roller. The fuser belt and the opposing belt extend in a downstream direction from the fusing nip and are configured to provide an appropriate length downstream of the fusing nip that sandwiches the image receiving medium substrate between the fuser belt and the opposing belt. Each of the fuser belt and the opposing belt wrap 70 degrees or more around significantly smaller diameter rollers positioned downstream of the fusing nip to form a stripping nip.

16 Claims, 5 Drawing Sheets

SYSTEMS AND METHODS FOR IMPLEMENTING A DOUBLE BELT ROLL FUSER GEOMETRY IN AN IMAGE FORMING DEVICE

BACKGROUND

1. Field of Disclosed Subject Matter

This disclosure relates to systems and methods for implementing an improved belt fuser assembly in an image forming device including employing a double belt roll fuser geometry to enable consistent self-stripping of image receiving media exiting the fuser assembly thereby improving image quality for the fused images on the image receiving media.

2. Related Art

The principles of operations in xerographic image forming devices are well known. Xerographic, and other toner-based, image forming devices include image marking units, that are generally used to transfer multiple colors of toner as the image marking medium onto an image receiving medium substrate in image forming devices including copiers, printers, facsimile machines and other like devices.

As is generally understood in xerography, for example, a photoconductive transfer element may be presented in the form of photoconductor belt. The photoconductor belt is mounted on, and driven by, a plurality of powered and follower photoconductor belt rollers. In operation, a photoconductive surface of the photoconductor belt is exposed to light images emitted from a light source as an imaging unit that optically exposes and selectively charges the photoconductive surface of the photoconductor belt to form an electrostatic latent image on the photoconductive surface. The selectively-charged surface of the photoconductor belt then passes a plurality of individual reservoirs, each supplying a different color of individually-charged toner particles. Multiple colors of charged toner particles from the plurality of individual reservoirs are deposited onto the charged surface of the photoconductor belt. Each color of toner supplied from the individual reservoirs has a charge, and will thus adhere to a particular area on the charged surface of the photoconductor belt in a manner to correspondingly color the electrostatic latent image to form a multi-color toner image.

The multi-color toner image is then transferred directly to an image receiving medium substrate at an image transfer nip formed between the photoconductor belt and a transfer roller. Alternatively, the multi-color toner image may be transferred directly from the photoconductor belt to an intermediate transfer element at an intermediate transfer nip formed between the photoconductor belt and the intermediate transfer element. When transferred from the photoconductor belt to the intermediate transfer element, the toner image may then be transferred from the intermediate transfer element to the image receiving medium substrate at an image transfer nip formed between the intermediate transfer element and a transfer roller.

The image transfer process is completed then by passing the image receiving medium substrate, with the toner image formed thereon, to a fuser unit. The fuser unit is used to fuse and fix the toner image on the image receiving medium substrate through an application of heat and/or pressure in the fuser unit to the transferred toner image on image receiving medium substrate. The image receiving medium substrate, with the toner image fused and fixed thereon, is then passed to an image receiving medium substrate output collection area or tray where the user collects the finished, permanently imaged documents in the image forming device.

Fusing units and modules have become increasingly sophisticated. FIG. 1 illustrates a schematic diagram of an exemplary embodiment of a conventional belt roll fuser 100. Generally, a belt roll fuser may circulate a fuser belt 110 around a series of heated rollers 115,125,135,145, including an internal pressure (or fuser) roller 145. A fusing nip may be formed by contact of the fuser belt 110 as it is sandwiched between the internal pressure (or fuser) roller 145 and an external pressure (or pressure) roller 150. Components of the belt roll fuser 100 typically include a tension roller 115 that cooperates with a belt tensioning unit 120 to provide belt tracking and steering, and belt tension control. A cleaner roller 135 can be provided to cooperate with some form of cleaner unit 130, such as a customer replaceable web belt cleaner, that is usable to remove residual toner and other debris from the fuser belt 110. A metering unit 140 can be provided to condition the fuser belt 110 with oil in operation. A number of thermistors (not shown) can be provided to monitor belt temperature with an objective of promoting even heating of the fuser belt 110.

In operation, the belt roll fuser 100 may receive an image receiving medium substrate from the marking unit (not shown) via an intermediate transport path 155. The intermediate transport path 155 may be aided and supported by some manner of intermediate transport unit 160 to the fusing nip. As the image receiving medium substrate emerges from the fusing nip, it may be aided in separation from the fuser belt 110 by interaction of the fuser belt with a stripping shoe 165, the operation of which may be supplemented by operation of an air knife 170. Because the image receiving medium tends to stick to the fusing belt 110 after passing through the fusing nip, the stripping shoe 165 provides a small, e.g., less than 5 mm, stripping radius such that the image receiving medium substrate is peeled away from the fuser belt 110. The fuser belt 110 wraps around the outside of the stripping shoe 165, and due to size and space constraints, creates three pressure zones as will be described in more detail below. Some form of exit sensor 175 may be provided to sense passage of the image receiving medium substrate to an output transport path 180 over which the image receiving medium substrate may be transported from the fusing unit to an output image receiving medium receptacle by operation of some form of output transport unit 185.

SUMMARY OF THE DISCLOSED EMBODIMENTS

Interaction between an image receiving medium substrate as it exits the fusing nip and the fuser belt 110 in a conventional fuser unit 100 may not be consistent. This is true because fuser rollers (see, e.g., element 145 in FIG. 1) tend to be designed with larger diameters in order to maximize the heated pressure surface at the fusing nip. The presence of a stripping shoe 165 immediately downstream of the fusing nip aids with separation of the image receiving medium substrate from the fuser belt 110 downstream of the fusing nip.

A closer view of the interaction between the image receiving medium substrate and the fuser belt immediately downstream of the fusing nip reveals the above-mentioned three distinct pressure zones which, varyingly affect the interaction between the image receiving medium substrate and the fuser belt in this area of the fusing device. The phenomenon describe below tends to result in introducing image defects in the fused image on the image receiving medium substrate. FIGS. 2A and 2B illustrate schematic representations of an exemplary interaction 200 between elements of a belt roll fuser in the vicinity of the fusing nip. In the same manner shown in FIG. 1, FIG. 2A depicts a fuser belt 210 sandwiched between a relatively harder surfaced heated fuser roller 245 and a relatively softer surfaced pressure roller 250. One or the other of the fuser roller 245 and the pressure roller 250 may have a comparatively softer surface than the other of the fuser roller 245 and the pressure roller 250 in order that one roller may force the fuser belt 210 across a longer radius of the other roller thereby extending a nip length of the fuser nip. As the fuser belt 210 emerges from the fuser nip, a small radius portion "R" (see FIG. 2B, element 205) is presented by interaction of the fuser belt 210 with the stripping shoe 265. This interaction causes the fused image receiving medium substrate 290 to be separated from the fuser belt 210 according to some variable stripping angle 295.

Three distinct zones operating or pressure zones N1, N2 and N3 are shown in FIG. 2A. These three distinct zones are broken down as follows: N1 is the high pressure zone that constitutes the fusing nip across a specified nip length; N2 is a low pressure nip area where the fuser belt 210 is caused to change direction while staying in contact with the pressure roller 250; and N3 is a so-called no contact area or a free leg of the fuser belt 210 belt over which the fuser belt 210 separates from the pressure roller 250 and proceeds tangent with the tip radius of the stripping shoe 265. Based on the inconsistency of contact between the image receiving medium substrate 290, the fuser belt 210 and the external pressure over 250, image quality defects can be generated in either or both of distinct operating or pressure zones N2 and N3.

By way of non-limiting example, consider a case where a leading edge of an image receiving medium substrate 290 travels through zone N2. The image receiving medium substrate 290, particularly in cases of a heavier weight sheet of the image receiving medium substrate 290, may not be able to conform to the shape of the pressure roller 250 where only tension of the fuser belt 210 may produce any down force, e.g. a comparatively low pressure in zone N2 of less than 10 psi. Due to a comparatively larger beam strength, the heavier weight sheet of image receiving medium 290 may tend to separate from a surface of the fuser belt 210, or at least lose sufficient contact force with the surface of the fuser belt 210. If this separation were clean, i.e., the image receiving medium substrate 290 separated from the surface of the fuser belt 210 completely, there may be no difficulty. What occurs, however, is that, based on the small distances between the elements in zone N2, the image receiving medium substrate 290 may exhibit a tendency to "re-touch" the heated surface of the fuser belt 210, particularly as a beam length of the image receiving medium substrate 290 increases. This re-touching may lead to one or more perceptible image quality defects in the image produced on the image surface of the image receiving medium substrate 290. A common example of such an image quality defect is a gloss defect commonly known to those of skill in the art as "icicles." Lighter weight image receiving media substrates may be able to tolerate a longer zone N2 before showing the defect, but the defect may still arise. Making some N2 very short may aid in minimizing the defect, but may introduce other geometry constraints that may interfere with effective stripping of the image receiving medium substrate 290 from the fuser belt 210. Conventional configurations for such devices have addressed this problem with the inclusion of additional hardware features such as, for example, a backup bar in zone N2 to provide a counteracting force to bend the sheet of image receiving medium substrate 290 into better compliance or conformance with pressure roller 250 to better address the change in bend direction occurring through zone N2.

Consider another case where, depending on image density and location, the image receiving medium substrate 290, may randomly stick to one or the other of the fuser belt 210 or the pressure roller 250 as the image receiving medium substrate 290 travels through the free leg zone N3. Here, the image receiving medium substrate 290 sometimes re-touches the surface of the fuser belt 210 after separating from it. This may cause the image quality defect known to those of skill in the art as "re-tack." Re-tack is a phenomena occurring in fusing systems whenever a freshly fused image is allowed to re-contact the hot fuser roller or belt surface. One manner by which to counteract the phenomenon of re-tack is shown in FIG. 1 in which air knife flow is left on at a reduced rate once the leading edge of the image receiving medium substrate has been stripped from the fuser belt by operation of the air knife. Effectiveness of this method is generally made possible in opposing roller type fusers by a sufficiently divergent path formed by the two rollers that create the fusing nip. In the case of a belt roll fuser, such as that shown in FIG. 1, in zone N3 area, the divergent surfaces tend to remain closer to each other, i.e., are not divergent enough, over a length of the zone and are so close to each other that any air knife flow tends to become stagnant in this area, and unable to prevent retouching to the fuser surface.

In order to address the above-identified shortfalls without improperly constraining design characteristics of, for example, roller sizes for the fuser roller and the pressure roller in a belt roll fuser device, it would be advantageous to provide systems and methods for more carefully controlling interaction of an image receiving medium substrate with a toner image fused as the image receiving medium substrate exits a fusing nip in an image forming device.

Exemplary embodiments of the disclosed systems and methods may provide improved interaction between an image receiving medium substrate and a fuser belt of a belt roll fuser device leading to improved and consistent image quality in an image forming device.

Exemplary embodiments may provide a configuration in which an opposing belt is provided around the pressure roller to oppose the fuser belt that is provided around the fuser roller.

Exemplary embodiments may provide that each of the fuser belt and the opposing belt may extend in a downstream direction from the fusing nip so as to remain in a configuration over an appropriate length downstream of the fusing nip that sandwiches an image receiving medium substrate between the fuser belt and the opposing belt exiting the fusing nip in a manner that substantially prevents an introduction of image quality defects for the fused image on the image receiving medium substrate based on random interaction between the image receiving medium substrate and fusing components in the image forming device.

Exemplary embodiments may provide that each of the fuser belt and the opposing belt wrap nearly 90 degrees around significantly smaller diameter rollers positioned appropriately downstream of the fusing nip. In exemplary embodiments, such a configuration may form a substantially self-stripping architecture based on an inability of even a lightweight image receiving medium substrate being able to follow a contour of the small diameter stripping rollers.

Exemplary embodiments may substantially or completely eliminate zone N3, thereby substantially or completely eliminating associated image quality defects, including re-tack, in this zone with an appropriately-configured double belt roll fusing device.

In exemplary embodiments, a zone N2 nip may still exist between two extending straight sections of the fuser belt and the opposing belt. An orientation of this zone N2 may be configured such that, although the pressure decreases from the pressure exerted on the image receiving medium substrate by the belt-wrapped rollers at the fusing nip, bending of the image receiving medium substrate exiting the fusing nip would be substantially or completely eliminated in this improved zone N2.

In exemplary embodiments, backup baffles may be added on either side of the zone N2 for additional support of extended straight sections of the fuser belt and the opposing belt between the fusing nip and the stripping nip.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing an improved belt fuser assembly in an image forming device including employing a double belt roll fuser geometry to enable consistent self-stripping of image receiving media exiting the fuser assembly will be described, in detail, with reference to the following drawings, in which.

DETAILED DESCRIPTION OF THE DISCLOSED EMBODIMENTS

The systems and methods for implementing an improved fuser assembly in an image forming device including employing a double belt roll fuser geometry to enable consistent self-stripping of image receiving media exiting the fuser assembly according to this disclosure will generally refer to this specific utility or function for those systems and methods. Exemplary embodiments described and depicted in this disclosure should not be interpreted as being specifically limited to any particular configuration of the described elements, or as being specifically directed to any particular intended use. Any advantageous use of the combination of elements in a fuser module to provide more consistent tracking of an image receiving medium substrate exiting a fuser nip in the fuser module, particularly those which may sandwich the image receiving medium substrate between elements in support of consistent flow of the image receiving medium substrate away from fusing surfaces is contemplated as being included in this disclosure.

Specific reference to, for example, any particular image forming devices, any particular fusing modules, or any specific arrangement of elements within an image forming device or a fusing module, should not be considered as, in any way, limited to any specific configurations for such devices or modules, or as being limited to only those devices or modules. Exemplary embodiments as depicted and described throughout this disclosure are intended to refer globally to toner-based image forming devices and systems that carry out a wide array of image forming operations, particularly those employing charged toner particles as the marking medium deposited on an image receiving medium substrate in an image forming step and subsequently fixed and fused to the image receiving medium substrate using a combination of heat and pressure, as those image forming operations would be familiar to those of skill in the art.

Figure 1:
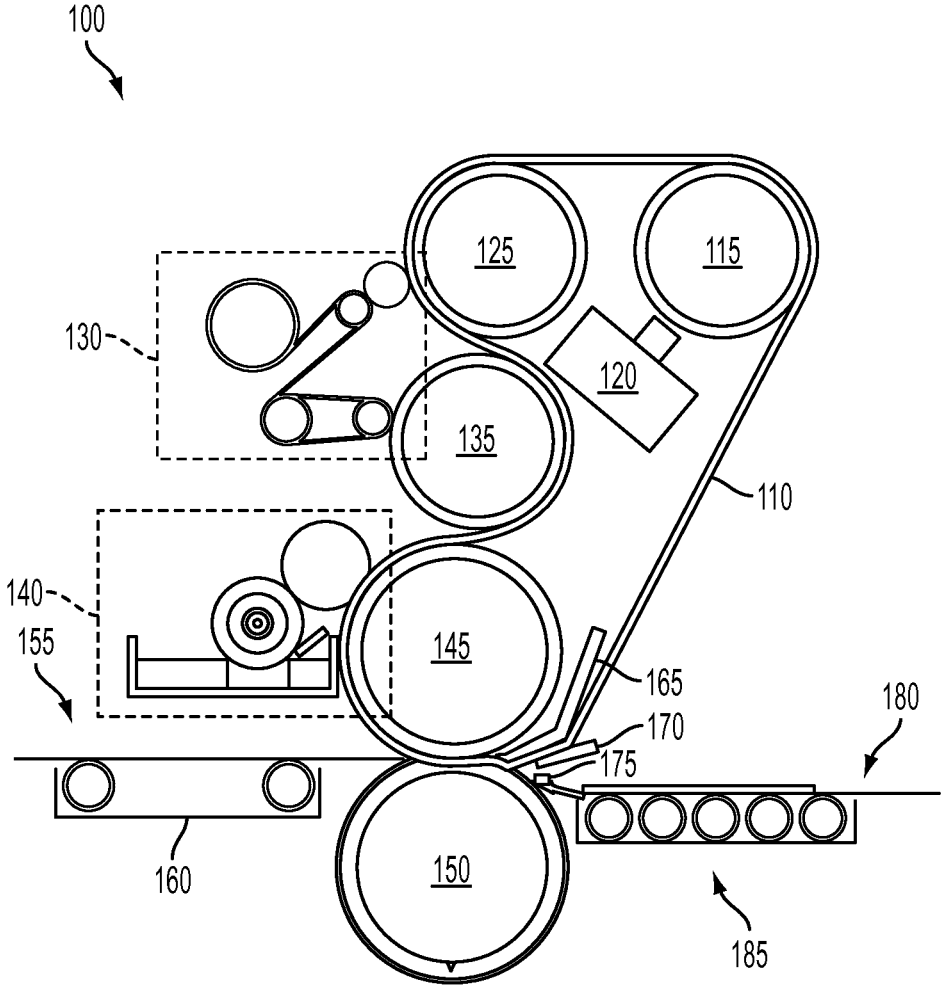
FIG. 1 RELATED ART
FIG. 1 illustrates a schematic diagram of an exemplary embodiment of a typical belt roll fuser assembly in an image forming device that may be improved upon with the systems and methods according to this disclosure.
Figure 3:
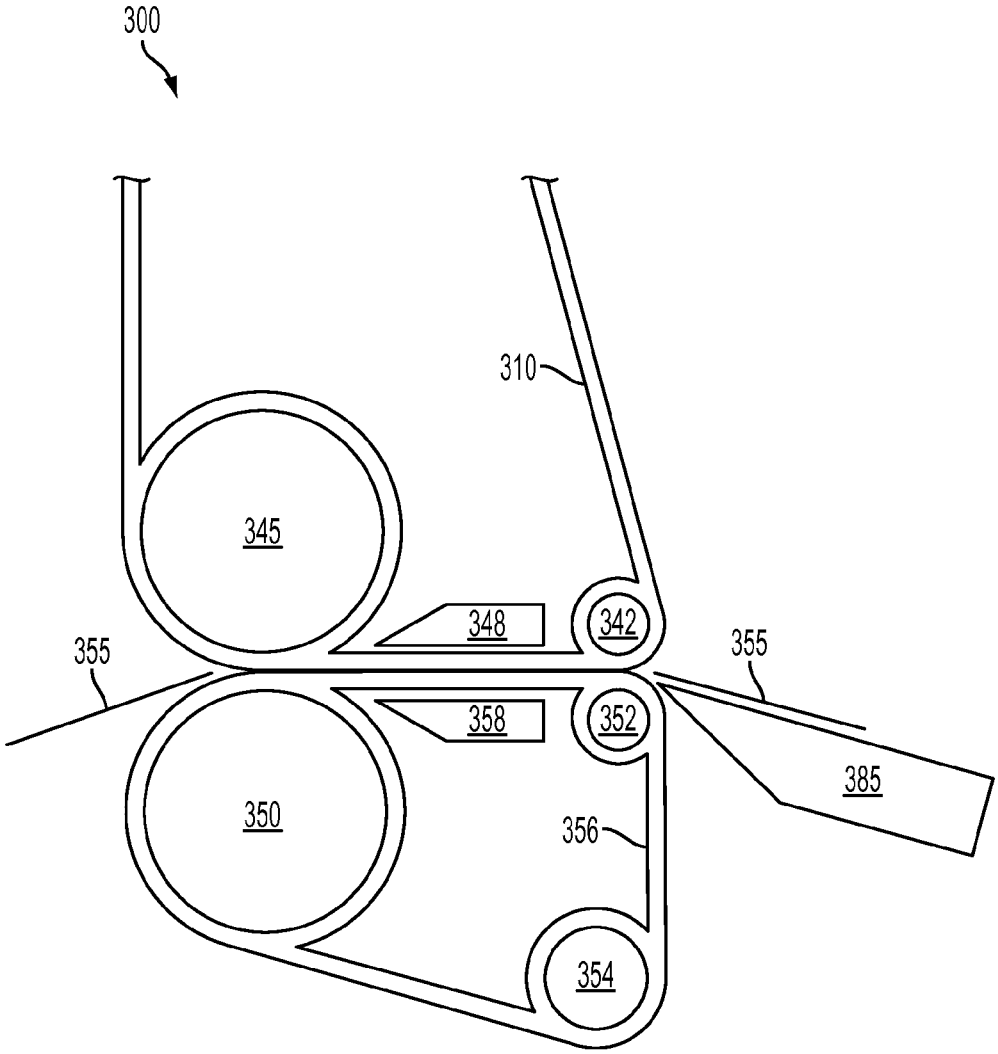
FIG. 3 illustrates a cutaway view of an exemplary double belt roll fuser assembly according to this disclosure.

FIG. 3 illustrates a cutaway view of an exemplary double belt roll fuser assembly 300 according to this disclosure. As shown in FIG. 3, and as is typical of belt roll fusers (see FIG. 1) a fuser belt 310 may be disposed, at least in part, around a fuser roller 345. Elements of a typical belt roll fuser assembly such as that shown in FIG. 1 are omitted from the depiction in FIG. 3 for clarity. Notably, in the proposed configuration for the fuser belt path, an additional stripping roller 342 may be placed at a downstream position in such a manner that the fuser belt 310 may extend in a direction tangentially from the fuser roller 345. In like manner, an additional opposing belt 356 may be disposed around the pressure roller 350 and a downstream stripping roller 352.

The configuration of a fuser roller 345, fuser belt 310, and small diameter stripping roller 342, opposed by an opposing belt 356 circulating around the pressure roller 350, a second small diameter stripping roller 352, and one or more additional rollers 354, provides a sandwiching pathway for an image receiving medium substrate exiting the fuser nip downstream over some extended path until the image receiving medium substrate exits the fusing module at a point where the fuser belt 310 and the opposing belt 356 make opposing significant turns, preferably 70° or more, and more preferably 90° or more, about the respective first and second small diameter stripping rollers 342,352 thereby allowing for stripping of the fused image receiving medium substrate from the pair of belts.

The exemplary configuration for the double belt roll fuser assembly 300 shown in FIG. 3 then provides a configuration in which both belts, the fuser belt 310 and the opposing belt 356 may run together to the small first and second stripping rollers 342,352. The fuser belt 310 may continue on to heat rollers, a tension roller/device, a web cleaning device, and a conditioning or oiling device, as seen in the conventional belt roll fuser concept shown in FIG. 1. The opposing belt 356 may circulate around the pressure roller 350 and the second stripping roller 352 and at least one additional roller 354 that may be configured as a tension and steering roll and then back onto the pressure roller 350. By using a hard profiled pressure roller, this exemplary design may provide adequate wrinkle control, as well as room in the architecture to allow alignment of the straight belt path with the natural exit angle from the fuser nip.

In operation then, an image receiving medium substrate 355 may enter the fusing nip formed between the fuser belt 310 and the opposing belt 356 at the point where the fuser roller 345 conforms with the pressure roller 350 to form the fusing nip. An image disposed on the input image receiving medium substrate 355 may be fused on the image receiving medium substrate 355 at the fusing nip. The straight-line configuration of the fuser belt 310 and the opposing belt 356 exiting the fusing nip may provide support for the image receiving medium substrate as it is made to exit the fusing nip in a more consistent and controlled manner. The image receiving medium substrate 355 may proceed along a path sandwiched between the fuser belt 310 and the opposing belt 356 until a point at which each of the fuser belt 310 and the opposing belt 356 make opposing significant turns, preferably of at least 70°, and more preferably of at least 90°, around small diameter stripping rollers 342,352, thereby facilitating stripping and release of the image receiving medium substrate 355 to be carried away by one or more outlet elements 385 to an output image receiving medium substrate component (not shown) where a user may retrieve the output image receiving medium substrate 355.

In embodiments, some backing force for the respective belts may be appropriate to control the belts and image receiving medium substrate sandwiched between them along the straight path portion of their travel between the fusing nip and stripping nip. This could be accomplished by providing backer plates as one or more support structures 348,358, which may be in the form of baffles, on respective sides of the fuser belt 310 and the opposing belt 356 to provide additional support in the straight-line portion of the transport path for the fuser belt 310 and the opposing belt 356 between the respective fuser roller 345 and the pressure roller 350 and the respective small diameter stripping rollers 342,352. These one or more support structures 348,358 may additionally aid in curtailing icicle defects as the image receiving medium substrate only has a straight path to follow along the belts.

The disclosed double belt roll fuser concept may provide a configuration that includes an extremely low pressure zone, at or near zero pressure, to transport the image receiving medium substrate 355 from the fusing nip to the extremely tight angled stripping nip between the respective first and second small diameter stripping rollers 342,352. In this manner, image defects such as, for example, icicle defects, which may be formed in the image on the image receiving medium substrate 355 may be mitigated as the image receiving medium substrate 355 exits the fusing nip sandwiched by the fuser belt 310 and the opposing belt 356, on both sides. The mitigation of image defects may be further enhanced by a configuration that aligns the path made by the pair of opposing belts with the natural trajectory of the image receiving medium substrate 355 exiting the nip. Such a configuration may serve to alleviate any bending forces on the image receiving medium substrate 355.

The beam forces of the image receiving medium substrate 355 and the adhesion of the image receiving medium substrate 355 to one or the other of the fuser belt 310 and the opposing belt 356 may all be caused to act in a substantially same and supporting direction.

An objective of the configuration shown in FIG. 3 is to ensure that the image receiving medium substrate 355 is not forced, in any manner, to attempt to follow one or the other of the fuser belt 310 or the opposing belt 356 in conformance with an external profile, for example, of one or the other of the fuser or pressure rollers 345,350 and the curves that such profiles typically produce in conventional configurations exiting the fusing nip. Farther downstream, the tight angles enabled by the relatively smaller diameters of the first and second stripping rollers 342,352 may allow even the lightest weight papers to self-strip. Such a configuration may remove any requirement for a separate air knife and stripping shoe component. Re-tack should be eliminated because of the robust self-stripping geometry.

Advantages of the disclosed design include providing a configuration that reduces instances of image quality defects associated with changes in pressures and directions for transport of image receiving medium substrates exiting the fusing nip in a fuser module. Exemplary embodiments of the disclosed designs may enable higher speeds for image production and reproduction by providing an opportunity for fuser rollers, i.e., fuser and pressure rollers to be appropriately sized, particularly to be made larger, to support increased nip lengths for the fuser nips in fuser modules.

Figure 2A:
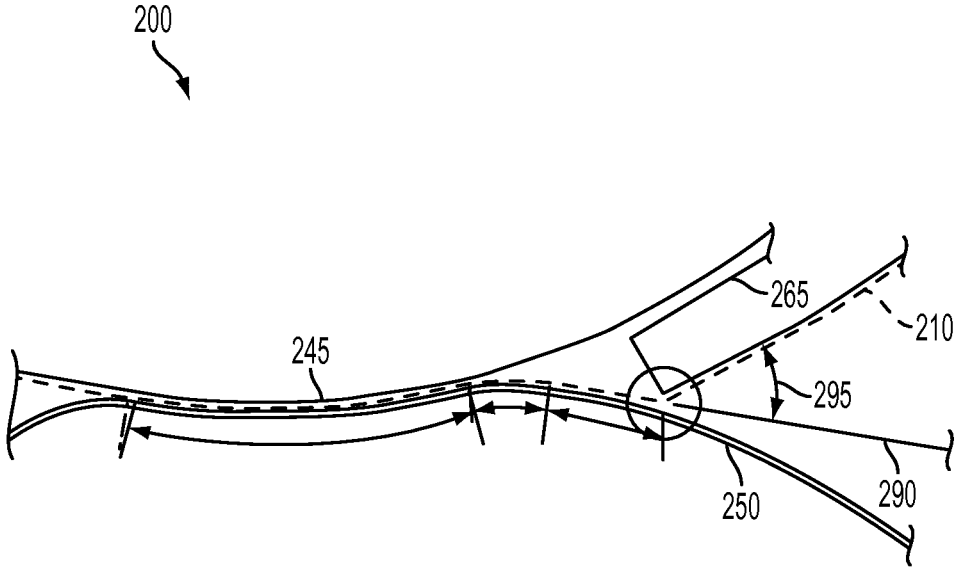
FIGS. 2A and 2B illustrate schematic representations of an exemplary interaction between elements of a belt roll fuser in the vicinity of a fusing nip that may be improved upon with the systems and methods according to this disclosure.
Figure 2B:
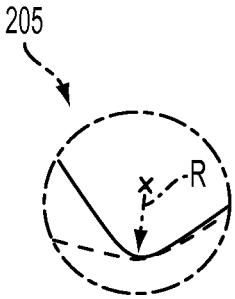

Among the novel concepts presented by the disclosed configuration for a double belt roll fuser geometry are the provision of the second belt around the pressure roller in addition to a the fuser belt around the fuser roller, and the additional provision of the secondary downstream small diameter stripper rollers for both belts. These elements are combinable to provide alignment of a belt path to an exit trajectory of the fusing nip to eliminate bending forces on the image receiving medium substrates as they exit the fusing nip. This configuration may generally be usable to eliminate image gloss defects (icicles) caused by the pressure zone N2 and N3 segments of the current design. See FIG. 2. This configuration generally promotes a robust self-stripping capacity for the image receiving medium substrates while eliminating requirements for additional structures including sophisticated air knives, stripping shoes or other like devices. All of this combines to provide an opportunity for the system designer to right-size individual components in support of increased fuser throughput, simplicity of design, and elimination of known image quality defects introduced in conventional fuser-exit designs.

Figure 4:
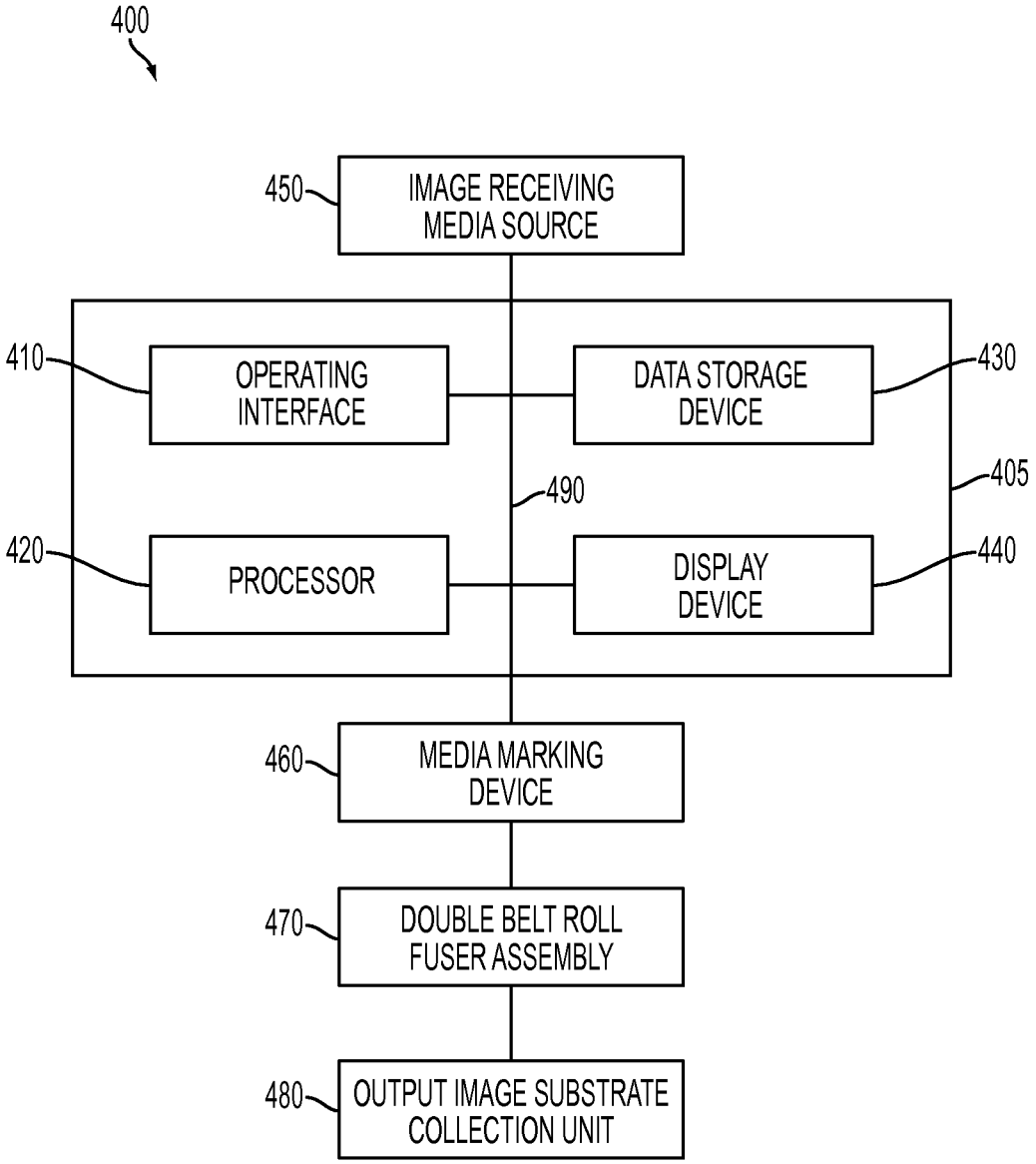
FIG. 4 illustrates a block diagram of an exemplary control system for operating and image forming device with a double belt roll fuser assembly according to disclosure.

FIG. 4 illustrates a block diagram of an exemplary control system 405 for operating and image forming device 400 with a double belt roll fuser assembly 470 according to this disclosure. All or some of the components of the exemplary control system 405 may be included in an image forming device 400. Otherwise, certain of the components of the exemplary control system 405 for undertaking processing and control functions may be housed in, for example, a separate computing device that may be associated with the image forming device 400.

Generally, in the image forming device 400, individual image receiving medium substrates (sheets) may be provided in an image receiving media source 450, which may include, for example, an image media source tray. The image receiving medium substrates may be transported to a media marking device 460 where the images are formed by depositing image marking material on the image receiving medium substrates. The image receiving medium substrates may then transported to the double belt roll fuser assembly 470, which may be configured substantially according to the exemplary embodiment shown in FIG. 3, or at least implementing one or more of the defining concepts for such a configuration, as discussed above. Once the image is fused and fixed on the image receiving medium substrate according to the disclosed concepts, the finished image receiving medium substrates may be transported to, and deposited in, an output image substrate collection unit 480.

The exemplary control system 405 may include an operating interface 410 by which a user may communicate with the exemplary control system 405 for directing image forming operations on the image receiving medium substrates in the image forming device 400. The operating interface 410 may be a locally accessible user interface associated with the image forming device 400. The operating interface 410 may be configured as one or more conventional mechanisms common to control devices and/or computing devices that may permit a user to input information to the exemplary control system 405. The operating interface 410 may include, for example, a conventional keyboard, a touchscreen with "soft" buttons or with various components for use with a compatible stylus, a microphone by which a user may provide oral commands to the exemplary control system 400 to be "translated"

by a voice recognition program, or other like device by which a user may communicate specific operating instructions to the exemplary control system 405. The operating interface 410 may be a part of a function of a graphical user interface (GUI) mounted on, integral to, or associated with, the image forming device 400 with which the exemplary control system 405 is associated.

The exemplary control system 405 may include one or more local processors 420 for individually operating the exemplary control system 405 and for carrying out operating functions in the image forming device 400 and particularly the double belt roll fuser assembly 470. Processor(s) 420 may include at least one conventional processor or microprocessor that interprets and executes instructions to direct specific functioning of the exemplary control system 405 and image forming device 400.

The exemplary control system 405 may include one or more data storage devices 430. Such data storage device(s) 430 may be used to store data or operating programs to be used by the exemplary control system 405, and specifically the processor(s) 420. Data storage device(s) 430 may be used to store information regarding individual operating characteristics of the double belt roll fuser assembly 470 to, for example control fuser temperatures and pressures, as well as fuser belt and opposing belt tracking in the double belt roll fuser assembly 470 in the image forming device 400. These stored schemes may control all operations of the image forming device 400 and the double belt roll fuser assembly 470. The data storage device(s) 430 may include a random access memory (RAM) or another type of dynamic storage device that is capable of storing updatable database information, and for separately storing instructions for execution of system operations by, for example, processor(s) 420. Data storage device(s) 430 may also include a read-only memory (ROM), which may include a conventional ROM device or another type of static storage device that stores static information and instructions for processor(s) 420. Further, the data storage device(s) 430 may be integral to the exemplary control system 405, or may be provided external to, and in wired or wireless communication with, the exemplary control system 405.

The exemplary control system 405 may include at least one data display device 440, which may be configured as one or more conventional mechanisms that output information to a user, including, but not limited to, a display screen on a GUI of the image forming device 400 with which the exemplary control system 405 may be associated. The data display device 440 may be used to indicate to a user a status of an image forming operation in the image forming device 400, or specific operation of the double belt roll fuser assembly 470 for executing image fusing operations.

All of the various components of the exemplary control system 405, as depicted in FIG. 4, may be connected internally, and to the image forming device 400, by one or more data/control busses 490. These data/control busses 490 may provide wired or wireless communication between the various components of the exemplary control system 405, whether all of those components are housed integrally in, or are otherwise external and connected to, an image forming device 400 with which the exemplary control system 405 may be associated.

It should be appreciated that, although depicted in FIG. 4 as an integral unit, the various disclosed elements of the exemplary control system 405 may be arranged in any combination of sub-systems as individual components or combinations of components, integral to a single unit, or external to, and in wired or wireless communication with, the single unit of the exemplary control system 405. In other words, no specific configuration as an integral unit or as a support unit is to be implied by the depiction in FIG. 4. Further, although depicted as individual units for ease of understanding of the details provided in this disclosure regarding the exemplary control system 405, it should be understood that the described functions of any of the individually-depicted components may be undertaken, for example, by one or more processors 420 connected to, and in communication with, one or more data storage device(s) 430, all of which support operations in the image forming device 400.

Figure 5:
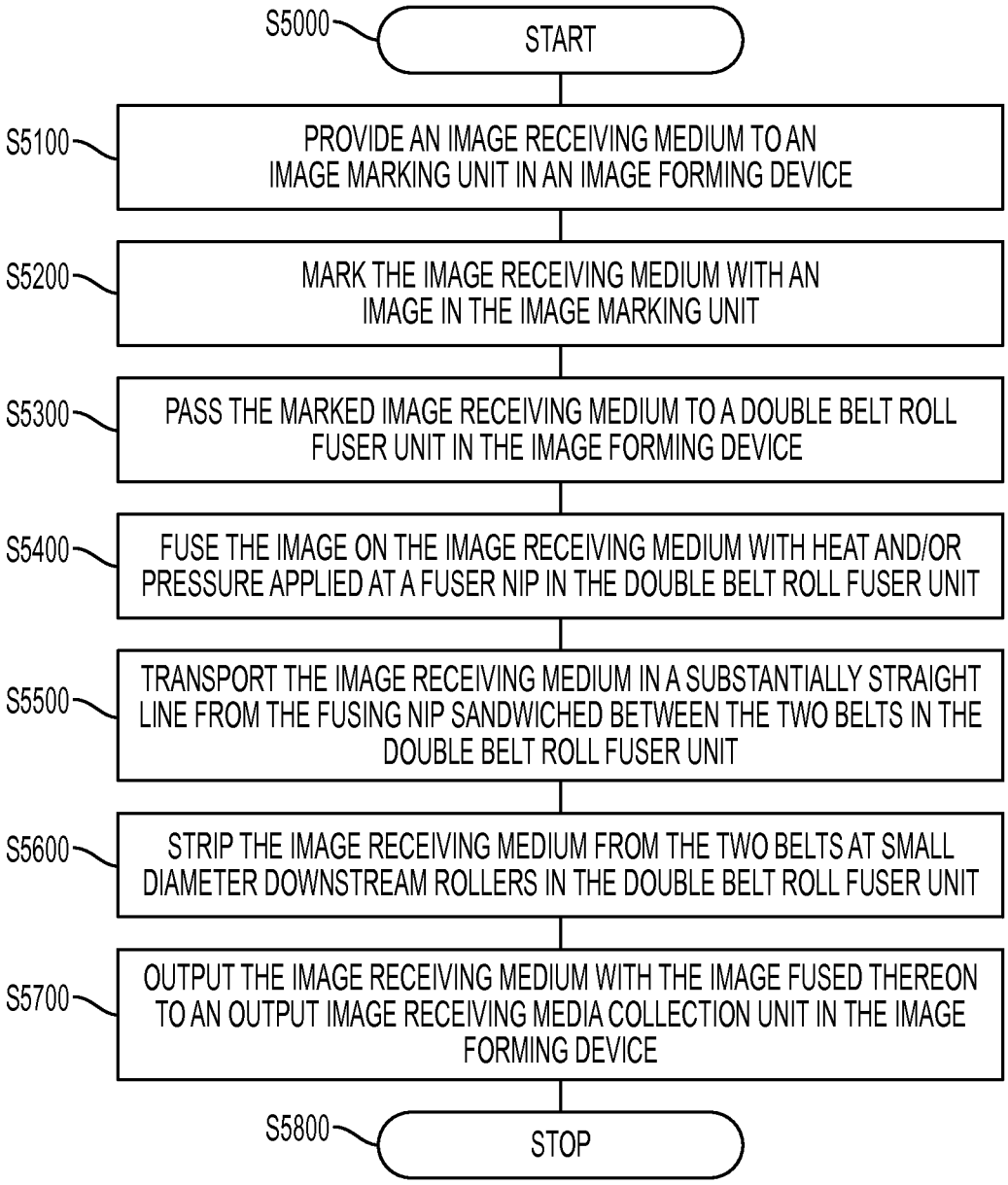
FIG. 5 illustrates a flowchart of an exemplary method for implementing image fusing using a double belt roll fuser assembly according to this disclosure.

The disclosed embodiments may include an exemplary method for implementing image fusing in an image forming device employing a double belt roll fuser assembly according to this disclosure. FIG. 5 illustrates a flowchart of such an exemplary method. As shown in FIG. 5, operation of the method commences at Step S5000 and proceeds to Step S5100.

In Step S5100, one or more sheets of image receiving medium substrate may be provided to an image marking unit in an image forming device. Operation of the method proceeds to Step S5200.

In Step S5200, the one or more sheets of image receiving medium substrate may be marked with images in the image marking unit according to known methods. The marking material may preferably be a charged toner particle marking material deposited on the one or more sheets of image receiving medium substrate according to known xerographic or electrostatic toner deposition and image marking/forming techniques. Operation of the method proceeds to Step S5300.

In Step S5300, the one or more sheets of image receiving medium substrate with images formed thereon may be passed to a fuser unit in a form double belt roll fuser unit in the image forming device. Operation of the method proceeds to Step S5400.

In Step S5400, the double belt roll fuser unit may fuse the image(s) on the one or more sheets of image receiving medium substrate at a fuser nip where a heated fuser belt is urged toward an opposing belt by positioning of a fuser roller about which the heated fuser belt is disposed. The opposing belt may apply pressure at the fusing nip through application of an urging force applied by a pressure roller about which the opposing belt is disposed. One or the other of the fuser roller and the pressure roller may include a soft outer surface in order that pressure of the components may cause the components to deform the outer surface of the roller at the fusing nip to extend a nip length of the fusing nip in a process direction. Operation of the method proceeds to Step S5500.

In Step S5500, a configuration of the double belt roll fuser unit may provide the each of the fuser belt and the opposing belt extend in a straight line that may be preferably aligned with a natural angle formed at the an outlet of the fusing nip. Such a configuration may provide that the one or more sheets of image receiving medium substrate are transported from the fusing nip in a substantially straight line, with no bending of the one or more sheets of image receiving medium substrate, while the one or more sheets of image receiving medium substrate, with the images fused thereon are sandwiched between the fuser belt and the opposing belt for transport clear of the fusing nip. This configuration of the double belt roll fuser unit may support more consistent transport of the fused image receiving medium substrates from the fusing nip in a manner that reduces image defects and variations caused in conventional belt roll fusers based on the inconsistencies in substrate handling at an exit of the fusing nip. Operation of the method proceeds to Step S5600.

In Step S5600, a self-stripping of the one or more sheets of image receiving medium substrate may be effected by causing the fuser belt and the opposing belt to turn away from one another at substantial angles. Preferably, the substantial angles of divergence may be 70° or more. The individual belts may turn essentially 90° around small diameter stripping rollers forming a stripping nip downstream if the fusing nip in the process direction. Small diameters of the respective stripping rollers may promote the self-stripping operation by essentially precluding an ability for even the most lightweight image receiving medium substrate stock to follow the contour of either of the respective belts as it turns around the stripping roller. Operation of the method proceeds to step S5700.

In Step S5700, the one or more sheets of image receiving medium substrate may be transported from the stripping nip of the double belt roll fuser unit to an output image receiving media collection unit, which may be in the form of an output image receiving media tray in the image forming device for user collection of the finished output image products. Operation of the method proceeds to Step S5800, where operation of the method ceases.

The disclosed embodiments may include a non-transitory computer readable medium on which is recorded instructions for causing a processor to execute an image forming operation in an image forming device equipped with a novel double belt roll fuser according to this disclosure.

The above-described exemplary systems and methods reference certain conventional components to provide a brief, general description of suitable image forming means and an image forming control means, which may be improved with the inclusion of the disclosed double belt roll fuser unit to reduce the incidence of image quality defects being introduced in a fusing step of the image forming operations. These references are made to provide clarity to the discussion of the disclosed improvements on conventional image forming and fusing systems and are not intended to be read as limiting the disclosed subject matter. Those skilled in the art will appreciate that other embodiments of the disclosed subject matter may be practiced with many types of image forming elements common to toner-based systems in many different configurations.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 5, and the accompanying description, except where a particular method step is a necessary precondition to execution of any other method step. Individual method steps may be carried out in sequence or in parallel in simultaneous or near simultaneous timing.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different and more complex image forming systems or applications. Various presently unforeseen or unanticipated alternatives, modifications, variations, or improvements therein may be subsequently made by those skilled in the art which are also intended to be encompassed by the following claims.

We claim:

1. A fusing device, comprising:

a fuser roller;

a fuser belt disposed around a portion of an external surface of the fuser roller;

a first stripping roller disposed downstream of the fuser roller in a process direction, the fuser belt being disposed around a portion of an external surface of the first stripping roller;

a pressure roller;

an opposing belt disposed around a portion of an external surface of the pressure roller; and a second stripping roller disposed downstream of the pressure roller in the process direction, the opposing belt being disposed around a portion of an external surface of the second stripping roller, wherein:

the fuser roller and the pressure roller are urged toward each other to form a fusing nip between the fuser belt and the opposing belt for fusing an image on an image receiving medium substrate, the first stripping roller and the second stripping roller are urged toward each other to form a stripping nip between the fuser belt and the opposing belt downstream of the fusing nip in the process direction, the first stripping roller and the second stripping roller are of a proportionally smaller diameter than the fuser roller and the pressure roller to promote self-stripping of the image receiving medium substrate from the fuser belt and the opposing belt, the fusing nip has a natural exit angle, the combination of the fuser belt and the opposing belt forming a substantially straight line sandwiching the image receiving medium substrate exiting the fusing nip, the first stripping roller and the second stripping roller are positioned to align the substantially straight line from the fusing nip to the stripping nip with the natural exit angle of the fusing nip, each of the fuser belt and the opposing belt has a substrate facing side and a non-substrate facing side and a first support structure is positioned between at least one of (1) the fuser roller and the first stripping roller on the non-substrate facing side of the fuser belt and (2) the pressure roller and the second stripping roller on the non-substrate facing side of the opposing belt, the first support structure contacting the belt to support the belt between the fusing nip and the stripping nip, and the first support structure has a flat surface that contacts the belt.

2. The fusing device of claim 1, wherein the fuser belt turns about the first stripping roller by at least 70° to promote self-stripping of the image receiving medium substrate from the fuser belt.

3. The fusing device of claim 1, wherein the opposing belt turns about the second stripping roller by at least 70° to promote self-stripping of the image receiving medium substrate from the opposing belt.

4. The fusing device of claim 1, wherein at least one of the fuser roller and the pressure roller includes a soft outer surface such that, when the fuser roller and the pressure roller are urged toward one another, the soft outer surface deforms to extend a nip length of the fusing nip.

5. The fusing device of claim 1, at least one of the fuser belt and the opposing belt circulating around an outer surface of another roller, the another roller providing at least one of tensioning and steering of the at least one of the fuser belt and the opposing belt as the at least one of the fuser belt and the opposing belt circulates in operation.

6. The fusing device of claim 1, wherein a second support structure is positioned between the other one of (1) the fuser roller and the first stripping roller on the non-substrate facing side of the fuser belt and (2) the pressure roller and the second stripping roller on the non-substrate facing side of the opposing belt, the second support structure contacting the belt to support the belt between the fusing nip and the stripping nip, the second support structure having a flat surface that contacts the belt, and the second support structure is located opposite to the first support structure such that their flat surfaces are opposite to each other and aligned with each other.

7. An image forming device, comprising:

an image receiving media input tray;

an image marking unit for marking images on image receiving media;

a first transport path for transporting image receiving media from the image receiving media input tray to the image marking unit in a process direction;

a fuser unit, the fuser unit comprising:

a fuser roller, a fuser belt disposed around a portion of an external surface of the fuser roller, a first stripping roller disposed downstream of the fuser roller in the process direction, the fuser belt being disposed around a portion of an external surface of the first stripping roller, a pressure roller, an opposing belt disposed around a portion of an external surface of the pressure roller, and a second stripping roller disposed downstream of the pressure roller in the process direction, the opposing belt being disposed around a portion of an external surface of the second stripping roller, the fuser roller and the pressure roller being urged toward each other to form a fusing nip between the fuser belt and the opposing belt for fusing the marked images on the image receiving media, the first stripping roller and the second stripping roller being urged toward each other to form a stripping nip between the fuser belt and the opposing belt downstream of the fusing nip in the process direction, the first stripping roller and the second stripping roller being of a proportionally smaller diameter than the fuser roller and the pressure roller to promote self-stripping of the image receiving media from the fuser belt and the opposing belt, the fusing nip having a natural exit angle, the combination of the fuser belt and the opposing belt forming a substantially straight line sandwiching the image receiving media exiting the fusing nip, and the first stripping roller and the second stripping roller being positioned to align the substantially straight line from the fusing nip to the stripping nip with the natural exit angle of the fusing nip;

a second transport path for transporting the image receiving media with the marked images from the image marking unit to the fuser unit;

an image receiving media output tray; and a third transport path for transporting the image receiving media with the marked images fused thereon from the fuser unit to the image receiving media output tray, wherein each of the fuser belt and the opposing belt has a substrate facing side and a non-substrate facing side and a first support structure is positioned between one of (1) the fuser roller and the first stripping roller on the non-substrate facing side of the fuser belt and (2) the pressure roller and the second stripping roller on the non-substrate facing side of the opposing belt, the first support structure contacting the belt to support the belt between the fusing nip and the stripping nip, and the first support structure has a flat surface that contacts the belt.

8. The image forming device of claim 7, wherein the fuser belt turns about the first stripping roller by at least 70° to promote self-stripping of the image receiving media from the fuser belt.

9. The image forming device of claim 7, wherein the opposing belt turns about the second stripping roller by at least 70° to promote self-stripping of the image receiving media from the opposing belt.

10. The image forming device of claim 7, wherein at least one of the fuser roller and the pressure roller includes a soft outer surface such that, when the fuser roller and the pressure roller are urged toward one another, the soft outer surface deforms to extend a nip length of the fusing nip.

11. The image forming device of claim 7, at least one of the fuser belt and the opposing belt circulating around an outer surface of another roller, the another roller providing at least one of tensioning and steering of the at least one of the fuser belt and the opposing belt as the at least one of the fuser belt and the opposing belt circulates in operation.

12. The image forming device of claim 7, wherein a second support structure is positioned between the other one of (1) the fuser roller and the first stripping roller on the non-substrate facing side of the fuser belt and (2) the pressure roller and the second stripping roller on the non-substrate facing side of the opposing belt, the second support structure contacting the belt to support the belt between the fusing nip and the stripping nip, the second support structure having a flat surface that contacts the belt, and the second support structure is located opposite to the first support structure such that their flat surfaces are opposite to each other and aligned with each other.

13. A method for fusing images marked on image receiving media in an image forming device, comprising:

providing a fuser belt to circulate around a portion of an external surface of a fuser roller and a portion on an external surface of a first stripping roller disposed downstream of the fuser roller in a process direction, the fuser belt having a substrate facing side and a non-substrate facing side providing an opposing belt to circulate around a portion a pressure roller and a portion of an external surface of a second stripping roller disposed downstream of the pressure roller in the process direction, the opposing belt having a substrate facing side and a non-substrate facing side;

urging the fuser roller and the pressure roller toward each other to form a fusing nip between the fuser belt and the opposing belt;

urging the first stripping roller and the second stripping roller toward each other to form a stripping nip between the fuser belt and the opposing belt downstream of the fusing nip in the process direction;

transporting image receiving media to the using nip to fuse a marked image on the image receiving media with a combination of heat and pressure;

transporting the image receiving media with the marked image fused thereon from the fusing nip to the stripping nip in a substantially straight line sandwiched between the fuser belt and the opposing belt, the fusing nip having a natural exit angle, the combination of the fuser belt and the opposing belt forming the substantially straight line exiting the fusing nip, and the first stripping roller and the second stripping roller being positioned to align the substantially straight line from the fusing nip to the stripping nip with the natural exit angle of the fusing nip;

supporting one of the fuser belt and the opposing belt with a first support structure positioned between one of (1) the fuser roller and the first stripping roller on the non-substrate facing side of the fuser belt and (2) the pressure roller and the second stripping roller on the non-substrate facing side of the opposing belt, the first support structure contacting the belt to support the belt between the fusing nip and the stripping nip, the first support structure having a flat surface that contacts the belt; and stripping the image receiving media from the fuser belt and the opposing belt by causing the respective belts to turn away from each other at substantial angles around the respective first and second stripping rollers at the stripping nip, the first stripping roller and the second stripping roller being of a proportionally smaller diameter than the fuser roller and the pressure roller to promote self-stripping of the image receiving media from the fuser belt and the opposing belt.

14. The method of claim 13, wherein the substantial angles are at least 70° to promote self-stripping of the image receiving media from the fuser belt and the opposing belt.

15. The method of claim 13, wherein at least one of the fuser roller and the pressure roller includes a soft outer surface such that, when the fuser roller and the pressure roller are urged toward one another, the soft outer surface deforms to extend a nip length of the fusing nip.

16. The method of claim 13, further comprising supporting the other of the fuser belt and the opposing belt with a second support structure positioned between the other one of (1) the fuser roller and the first stripping roller on the non-substrate facing side of the fuser belt and (2) the pressure roller and the second stripping roller on the non-substrate facing side of the opposing belt, the second support structure contacting the belt to support the belt between the fusing nip and the stripping nip, the second support structure having a flat surface that contacts the belt, wherein the second support structure is located opposite to the first support structure such that their flat surfaces are opposite to each other and aligned with each other.

* * * * *